United States Patent [19]

Cheeseman

[11] Patent Number: 4,798,111

[45] Date of Patent: Jan. 17, 1989

[54] SOCKET-WRENCH HAND TOOL

[76] Inventor: Charles D. Cheeseman, 18 S. Maple St., Greens Fork, Ind. 47345

[21] Appl. No.: 81,030

[22] Filed: Aug. 3, 1987

[51] Int. Cl.[4] ..... B25B 23/16

[52] U.S. Cl. ..... 81/124.4; 81/177.4

[58] Field of Search ..... 81/124.4, 124.5, 177.4, 81/490, 437, 438, 439, 440

[56] References Cited

U.S. PATENT DOCUMENTS

| | | | |
|---|---|---|---|
| 1,371,350 | 3/1921 | Cambell | 81/177.4 |
| 1,381,889 | 6/1921 | Arnold | 81/177.4 |
| 2,776,589 | 1/1957 | Gregory | 81/177.4 |
| 2,991,678 | 7/1961 | Adolphson | 81/124.4 |
| 3,651,720 | 3/1972 | Indyk | 81/124.5 |
| 4,620,460 | 11/1986 | Gonzoles | 81/124.4 |

FOREIGN PATENT DOCUMENTS

| | | | |
|---|---|---|---|
| 0735672 | 6/1966 | Canada | 81/124.4 |

*Primary Examiner*—Frederich R. Schmidt

*Assistant Examiner*—Blynn Shideler

*Attorney, Agent, or Firm*—Robert A. Spray

[57] ABSTRACT

A socket wrench device, having a shank, a plurality of socket pieces to give optionality of size, a retainer component adjacent the outer end of the shank, and with an abutment adjacent the inner end of the shank, the arrangement providing the feature that all the socket pieces which are inwardly of the outermost socket piece transmit the axial force from the abutment and sustain the reaction force form the work object, thus assuring that socket pieces unused for applying the torque work-effort to the work object must be kept on the shank for ready availability for the next use of the device, and permitting the outer retainer component to be conveniently weak for easy loading of sockets onto the shank since it need only be strong enough to retain sockets against falling off the end of the shank. Different size socket at each end of each socket provide maximum size-differences for optionality of use.

14 Claims, 1 Drawing Sheet

SOCKET-WRENCH HAND TOOL

FIELD OF THE INVENTION

The present invention relates to hand tools, and more particularly relates to a hand tool which provides a set of different size socket pieces for optional use, depending on the size of the work object to which forceful torque-effort is to be applied.

Still more particularly, this invention relates to such a hand tool, providing a set or kit of socket pieces, which is adapted to "carry along" socket pieces not being used for the torque effort of that particular task.

In distinction to hand tools of the prior art, as herein specified, the present invention provides novel concepts of construction and operativity.

The Invention and the inventive distinctions over the Prior Art, Summarized

A basic distinction of the invention over the prior art is particularly the provision of the novel feature that all the socket pieces which in use of the tool and ensleeved on the tool shank inwardly of the outermost socket piece are "active" in the sense that they are in series with and transmit the axial force from an inner abutment on the tool shank, and sustain the reaction force from the work object, in contrast to being merely "passively" carried along on the tool shank with no axial-force-sustaining operativity.

In other words, all the socket pieces of the kit or set are always active, i.e., being either the outermost one which engages and gives torque work-effort to the associated workpiece, or being one of the inner socket pieces which actively transmit and sustain axial force.

(The outermost socket piece is of course also "active" in transmitting the axial force, as in the prior art; but, in the prior art, it was only the outermost socket piece which was active in that respect.)

The above-indicated "active" nature of the inner socket pieces, as being in axial force-transmission operatively with an abutment adjacent the inner end of the tool shank, provides two primary advantages over the prior art tools which bear a superficial resemblance to the tool of this invention, as follows:

(a.) The retainer device or means adjacent the outer end of the tool shank is permitted to be conveniently weak for easy loading of sockets onto the shank, since it need only be strong enough to retain sockets against falling off the end of the shank.

That retainer need not transmit any axial force, which in use of the tool would always exist by axial pressure by the user onto the work object during the torque-imposition effort and/or by the axial component of reaction effort of the work object; and thus the retainer is permitted to be a very weak, permittig great ease of ensleeving socket pieces onto the tool shank.

(b.) The axial-force transmission required of all the inner socket pieces requires the user to be sure to ensleeve them onto the tool shank, thus automatically and positively assuring that socket pieces, which on a particular occasion of a task are unused for applying the torque work-effort to the work object, must be kept on the shank, providing automatically for the ready availability for the next use of the device, avoiding the chance of mislaying an unused socket or sockets.

This is especially an advantage in use of a hand tool, for, as is well known, many tasks requiring a hand tool such as a socket tool are tasks necessarily at a site other than an orderly work bench.

A further distinction of the present invention over prior art kits or sets of sockets for optional use depending on work-object size is that different size sockets as provided at each end of each socket, provide maximum size-differences for optionality of use.

As a factor of this feature, it is to be noted that it is only the central socket-portion of each socket piece which is mated in size and shape to the tool shank, and both ends of each socket piece are different from one another.

In contrast, even the prior art sets which have a concept of providing a different size/shape nature for one end of each socket piece seem to lack what might by hindsight seem to be a correlative concept, i.e., of a different size/shape for the other end of each socket, presumably because their apparent need of use of one end of each socket piece to be a mate with the tool shank or its retainer device.

The Prior Art has tried different solutions to the problem of convenient usability of multiple-socket tools Of course hand-held socket tools have been known and used for scores of years; and as shown herein socket tools have been also long known which carried a plurality of socket pieces for optional use.

However, the existence of such articles of the prior art is not only conceded, it is emphasized; for it is with similarities to long-known components and concepts that the present inventive concepts build, accomplishing a device of a construction and an operativity significantly different than just the components and operativities of those long-known articles of the prior art, and thus the inventive significance of the present concepts is emphasized, and the nature of the concepts and their results can perhaps be easier understood.

Even further as indicating the inventive nature of the present concepts is the result of a Preliminary Patentability Search made in the Search files of the U.S. Patent Office, after this invention was made, and during the course of considering the desire and likelihood of patent protection.

The Search produced the following, all U.S. Patents:

| | | |
|---|---|---|
| 1,371,350 | Campbell | 3/15/21 |
| 1,416,461 | Hance | 5/16/22 |
| 1,662,424 | Judge | 3/13/28 |
| 2,776,589 | Gregory | 1/08/57 |
| Reissue 31,140 | Martinmaas | 2/08/83 |

None of those references, however, show the concepts of either of the features of the present invention, as now shown.

The Campbell patent shows that at least as early as 1921 is shown a series of socket pieces sleeved onto a tool-shank; but they seem to be merely carried along if the user remembers to ensleeve them onto the shank, for the carried-along pieces seem not to transmit axial force, and no abutment seems provided by the handle or otherwise to impose axial force on them for sustaining the reaction force of the work-object. Moreover, the sockets are all of the same size at one of their ends, that being the size of the tool-shank in all cases.

In the Hance device of 1922, a plurality of socket pieces are carried on a shank, but they are not used as torque transmitters when so carried; and axial force-sustaining is not carried through the series of sockets, but instead by an abutment adjacent the outer end of the shank. Further, the differences in socket-sizes are provided at only one end of the socket pieces.

The Judge tool of 1928 likewise differs from the present invention in that although several socket pieces may be ensleeved onto the shank, the axial force is not transmitted through the series of socket pieces but by a stop near the outer and of the shank. Also, the differences in socket sizes are provided at only one end of the socket pieces.

In the Gregory tool of 1959, several socket pieces are ensleeved on a shank, but there appears that the work-object reaction axial force is not transmitted through the carried series. As with the others, it appears that the differences in socket sizes are provided at only one end of the socket pieces.

As to the most current one, i.e., the Martinmaas tool of 1983, it has a series of socket pieces carried along in a trough-like handle member, in a manner so that they will not interfere with the wrench operativity while using any selected one of the socket pieces, quite unlike the operativity of the carried-along sockets of the present invention which provide not only an active role but the only axial force-sustaining operativity as to the sustaining of the axial reaction force of the work-objects. Also, as with the others, it appears that the differences in socket sizes are provided at only one end of the socket pieces.

The invention's components and concepts are similar to those available in the prior art, except for the present concepts in particular In a hindsight consideration of the present invention to determine its inventive and novel nature, it is not only conceded but emphasized that the prior art had details usable in this invention if the prior art had had the guidance of the present concepts.

That is, it is emphasized that the prior art had several particulars:

a. The prior art hand tools of socket wrench type, with a plurality of socket pieces to be optionally used for various size work-objects.

b. The prior art had socket tools in which socket pieces unused for the task could be ensleeved onto a shank.

c. However, the prior art did not have the inventive creativity to use or conceive of a carry-along feature by which the sockets unused for the torque-effort are required to have an active duty of transmission of axial force, and with an outer retainer member required to only hold the outer socket piece from falling off; for all the axial force-transmission is also transmitted through the socket pieces not being used for the torque-effort, and to an inner abutment here preferably provided by the device handle itself.

d. The prior art has long had socket pieces provided as a set or kit providing optionally-usable different sizes, but the prior art did not have the creativity to use socket pieces with different size sockets at both ends by providing that the socket-portion being held to the shaft member was a central socket portion instead of one end portion of the socket piece.

Accordingly, the various concepts and components are conceded and emphasized to have been widely known in the prior art in hand tool products and devices even of plural-socket type; nevertheless, the prior art not having had these concepts, even only a fair amount of realistic humility, to avoid consideration of this invention improperly by hindsight, requires the concepts and achievement here to be realistically viewed as inventive in their nature.

BRIEF DESCRIPTION OF THE DRAWINGS

The above description of the novel and advantageous hand tool, which provides a socket set or kit with novel features, is of somewhat introductory and generalized form. More particular details, concepts, and features are set forth in the following and more detailed description of an illustrative embodiment, taken in conjunction with the accompanying drawings, which are of somewhat schematic and diagrammatic nature, for showing of the inventive concepts for such a hand tool as the concepts of the present invention are illustrated in this embodiment.

In the drawings

DETAILED DESCRIPTION OF PREFERRED EMBODIMENT OF THE INVENTION

Figure 1:
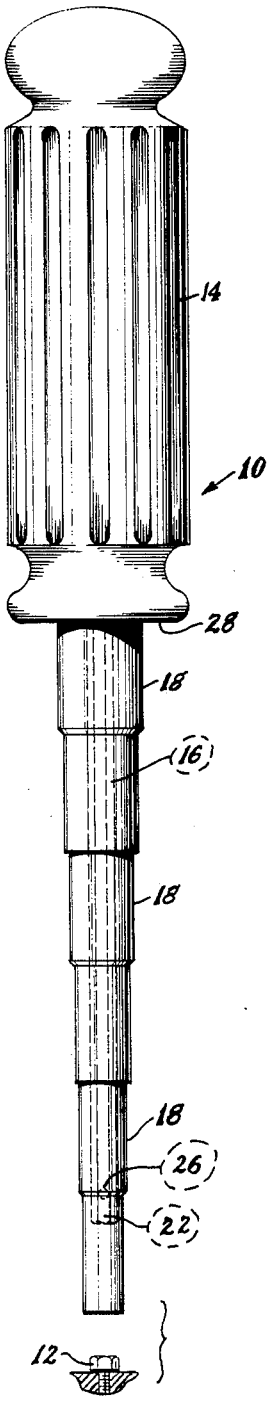
FIG. 1 is an elevation view of a socket-wrench hand tool, of a three-socket embodiment for providing six optionally-selectable socket sizes, this view showing the three socket pieces arranged on the tool shank such as to provide that the smallest socket size of the set is to be the one to give the twist or torque effort to an associated workpiece.
Figure 3:
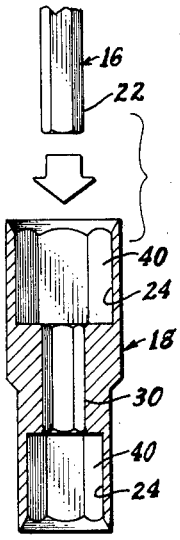
FIG. 3, in larger scale, is an axial cross-sectional view of one of the socket members, and showing an end portion of the tool shank as it and the socket piece are to be assembled as indicated by the reference arrow.

An illustrative of the inventive concepts, the drawings show a hand tool 10 for applying a twist effort to a nut, bolt head or whatever may pose the need to apply twist or rotational torque to a work object 12; and the general components of the tool are a handle 14, a shank 16 extending from the handle 14, and a set of socket members or body-pieces 18 for providing for mating with a variety of sizes and/or shapes of the work object 12.

More particulars of those general components are now described, showing not only the details of construction and concept but the use of the tool components and the feature of particular significance over the prior art.

The shank member 16 has its inner end 20 and its outer end 22 substantially spaced apart for carrying the socket pieces 18 on the shank 16; and for connecting the handle member 14 to the shank member 16, there are suitable connection means 23 such as glue and for a tight fit of a non-circular inner end 20 of the shank 16 in the handle-hole **23*a* which receives it. The connection of the handle member 14 and the shank member 16 being adjacent the inner end 20 of the shank member 16, all of the shank member 16 except its inner end portion 20 freely extends from the handle 14**.

All of the plurality or set of socket members 18 are alike in having a hollow bore 24 of a size and nature adapted to permit the socket members 18 all to be sleeved onto and carried by the shank member 16, in a series or end-to-end grouping arrangement on the shank member 16, as more particularly described herein.

The shank member 16 is shown as provided adjacent its outer end 22 with a releasable connector means 26, it being of a nature and at a particular location along the shank 16 as further specified herein.

Here provided by the outwardly-facing end 28 of the handle 14, that is the handle-end facing the outer end 22 of the shank 16, the shank member 16 is provided with an outwardly-facing abutment means 28 blocking movement of any socket member 18 along the shank 16 inwardly of that abutment 28; and the location of that shank abutment 28 defines a specific distance between the shank member's releasable connector means 26 and the shank member's abutment means 28, for special operativity shown herein.

The general similarity of the socket members 18 includes the fact that the length of the several socket members 18 is all uniform; and more particularly the length of each of the socket members 18 is such that the total length of all the socket members 18, minus one-half of a length of one of the socket members 18, is generally equal to the specific distance mentioned above, that is, the distance between the shank member's releasable connector means 26 the shank member's abutment means 28.

The provision and operativity of a shaft-abutment 28, and those length relationships, are quite significant as features of the present invention, as further explained herein.

Figure 4:
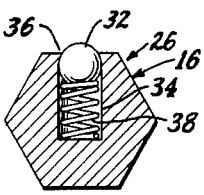
FIG. 4, in further enlarged scale, is a transverse cross-sectional view through the tool shank at the location therealong of the shank's snubber ball feature which retains socket pieces from falling off the free end of the tool shank.
Figure 2:
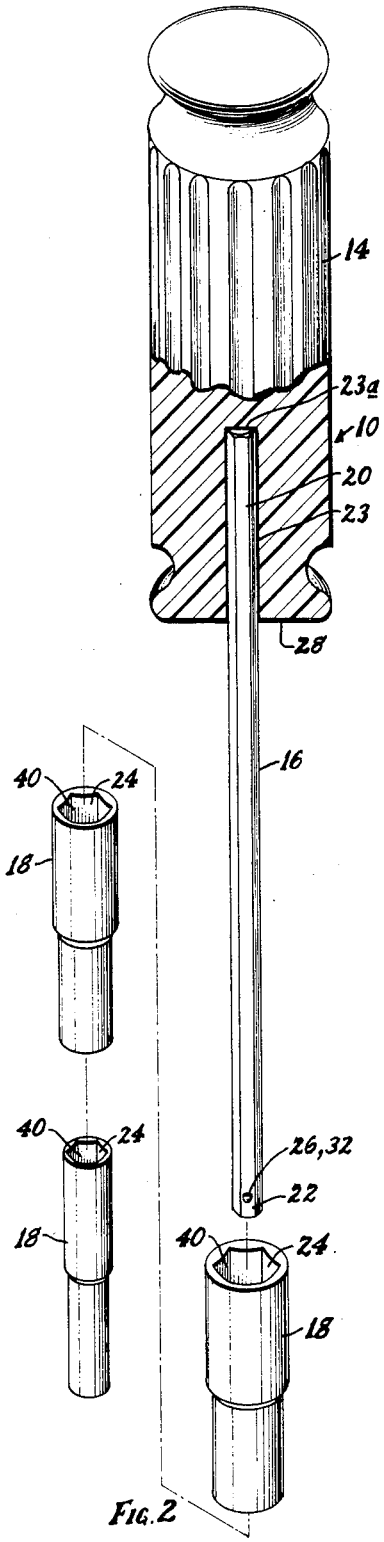
FIG. 2 is a pictorial view of the hand tool of FIG. 1, with part of the handle being shown in cross-section, and with the three socket pieces shown in so-called "exploded view," i.e., off the tool shank but ready to be assembled onto the tool shank along the chain line as an assembly-indication, that line being shown in broken form to accommodate full showing of all the socket pieces within the limits of the drawing paper.

Each of the socket members 18 is provided with a releasable connector means 30 which is co-operative with the shank member's releasable connector means 26 to releasably retain the outermost one of the socket members 18 from freely moving outwardly of the shank member 16; and, needing only that small amount of strength, the connection 26/30 is desirably of a weak nature, as is shown as provided by the shank 16 being provided with a spring-pressed snubber ball feature (FIG. 4).

The shank 16 is shown as hexagonal in cross-section, and its non-circular nature, coupled with a similar sized hexagonal cross-section of the connector means 30 central portion of the bore 24 of each socket body piece 18, provides rotation-blocking means operable between the outer end portion 22 of the shank member 16 and the outermost one of the socket members 18 ensleeved onto the shank 16, to provide that as the user applies rotational torque to the handle member 14 such torque (which then is transmitted to the shank member 16 by the connection means 23 which connect the handle member 14 to the shank member 16) will be transmitted operatively to that outermost socket member 18 for attaining the desired torque or twist operativity effect onto the work object 12.

A special characteristic of the tool 10 and its inventive concepts, as distinguishing over the prior art, in the overall combination herein detailed, is that the shank member's abutment member 28 provides a means for the transmission of axial force through all of the sockets 18 carried on the shank member 16 by the engagement of the shaft-abutment 28 with the innermost one of the socket members 18.

Co-operating with that concept, it will be recalled that the releasable connection means 26/30, co-operative between the shank member's releasable connection means 26 and the outermost socket member's releasable connection means 30, is desirably quite weak. More particularly, that releasable connection 26/30 is too weak to retain the outermost socket member 18 from being forced inwardly toward the handle member 14 by the reaction by the work object 12 against the axial force applied to the shank member 16 by the user in using the tool 10; and that inward-movement retention or blocking, instead, is wholly by force transmission operative from the shank's abutment means 28 and through the socket members 18 which are inwardly of the outermost one of the socket members 18 as are carried on the shank member 16.

Thus is achieved both an ease of ensleeving the socket members 18 onto the shank 16, and also an assurance that socket members 18 being unused for the torque-effect as to the workpiece 12 are always kept on the shank 16 as required for their active participation in the axial force-transmission, thus assuredly being handily convenient for a later task in which their particular size/shape nature will cause them to be optionally chosen for the torque-transmitting effort in a later task.

(The expression "size/shape" is used to indicate whatever is the distinctness of either size or shape as considering differences in the nature of the torque-significant features relating to the torque-imposition task.)

As shown perhaps most clearly in FIG. 4, the shank's releasable connection means 26 is provided by a snubber ball 32 spring-pressed radially outwardly in a radial hole 34 of the shaft member 16, against an outer lip 36 of the hole 34, the spring being shown by a short coil-spring 38, a releasable connection means which is well known in the prior art.

Further as to the socket body pieces or members 18, at least one of the socket members 18 has its female-nature socket 40 at each of its ends of diffeent size/-shape nature than the socket 40 at the other end of the socket member 18, and preferably no more than one of any of the various end-sockets 40 would be of the same size/shape nature as that of the shank 16, maximizig size/shape optionality; and with the releasable connector means 26/30 permitting the various socket members 18 to be optionally used as the outermost socket member 18 for operatively engaging the associated work object, for torque-force imposition, and either end of the outermost socket member 18 permitted to be optionally carried as the outwardly facing end thereof, thereby is provided the optionality of each end socket 40 of each socket member 18 to be the one which is selected to be used to operatively impose torque-engagement to the work object 12, maximizing optionality with preferably all the socket members 18 to be thus different at each end from one another and from the shank 16.

Conclusion

It is thus seen that a hand tool, constructed and used according to the inventive concepts herein set forth, provides novel concepts of a desirable and advantageous device, yielding the advantages of a socket-wrench kit which provides optionally-usable work-engaging sockets of various sizes, and with carry-along concepts which assure that sockets not in use for a particular task will be kept handy and available for the next task by the special nature of the carry-along feature assuring that unused sockets are positioed on the tool shank for needed active service of axial-force sustaining. Moreover, the optionability of use is achieved by providing each socket member to have sockets of different sizes of each of its ends.

In summary as to the nature of these advantageous concepts, their inventiveness is shown by novel features of concept and construction shown herein, and by the novel concepts hereof not only being different from all the prior art known, but because the achievement is not what is or has been suggested to those of ordinary skill in the art, especially realistically considering this as comprising components which individually are similar in nature to what is well known to most persons, surely including most of the many makers and users of most conventional socket tools for many years, the entire world over. No prior art has suggested the modifications of any prior art to achieve the novel concepts here achieved, with the socket pieces all being required and used for either axial force sustaining or rotational torque transmitting, regardless of the optionally-chosen socket member chosen for the torque-effort engagement of a particular work piece, even though carry-along and different size socket-piece wrench kits of various other natures have been known for years; and quite certainly no particular combination of prior art has been suggested by the prior art, this achievement being a substantial and advantageous departure from prior art, even though the prior art shows attempts at improvement for many years. And partcularly is the overall difference from the prior art significant when the non-obviousness is viewed by the consideration of the subject matter as a whole, as integrally incorporating the features different from the prior art, in contrast to merely those details of novelty themselves, and further in view of the prior art teaching away from the concurrent active participation of all sockets of the set.

Accordingly, it will thus be seen form the foregoing description of the invention according to this illustrative embodiment, considered with the accompanying drawings, that the present invention provides new and useful concepts of a novel and advantageous socket wrench kit or set having and yielding desired advantages and characteristics in formation and use, and accomplishing the intended objects, including those hereinbefore pointed out and others which are inherent in the invention.

Modifications and variations may be effected without departing from the scope of the novel concepts of the invention; accordingly, the invention is not limited to the specific embodiment, or form or arrangement of parts herein described or shown. Thus, the term "socket" is used in its broad sense of wall-length and/or wall segments sufficient to impart torque, not necessarily a full 360° in extent. And the term "handle" does not necessarily mean a component non-integral with the shank as in the illustrative embodiment shown herein as preferred. Also, although the distance relation between the shaft length (between components 26 and 28) is generally the length of all sockets minus one-half a socket length, and although all socket pieces are operatively uniform in length, these relationships are not needed nor meant to be necessarily geometrically precise, but only operatively close to provide the operativity characteristics and advantages specified.

I claim:

1. A hand tool for applying rotational torque to a work object, comprising, in combination:

a shank member having an inner end and an outer end substantially spaced apart;

a handle member for the shank member;

connection means connecting the handle member and the shank member adjacent the inner end of the shank member;

a plurality of socket members, each having a hollow bore, adapted to be sleeved onto and carried by the shank member in a series arrangement on the shank member;

the shank member being provided adjacent its outer end with a releasable connector means but devoid of any abutment at or adjacent the shank member's outer end which would prevent passage of the socket members onto and along the shank member, the shank member thus permitting all of the socket members to be manually pushed onto the shank member and into said series arrangement sleeved thereupon by entrance onto the shank member's outer end and relatively moved along the shank member toward the shank member's inner end, and with all of the socket members except the outermost one, which is the one to be used for torque-application effect, having been ensleevedly moved along said shank member and past the shank member's releasable connector means;

the shank member being provided with an outwardly-facing abutment means blocking movement of a socket member inwardly thereof, and defining a specific distance between the shank member's releasable connector means and the shank member's abutment means;

the length of the said socket members being operatively uniform, and such that the total length of all the socket members, minus one-half of a length of one of the socket members, is generally equal to the said specific distance between the shank member's releasable connector means and shank member's abutment means;

each of the socket members being provided with a releasable connector means "located centrally within the socket member" and co-operative with the shank member's releasable connector means to releasably retain the outermost one of the socket members from freely moving outwardly of the shank member "forming a releasable connection therebetween";

rotation-blocking means operable between the outer end of the shank member and the outermost socket member to provide that as the user applies rotational torque to the handle member, the torque, as will be then transmitted to the shank member by the connection means which connect the handle member to the shank member, will be transmitted to the outermost socket member;

the shank member's abutment means providing a means for the transmission of axial force through all of the socket members carried on the shank member, by its engagement with the innermost one of the socket members, all the socket members thus being active in such force transmission;

and said releasable connection formed between the shank member's releasable connector means and the outermost socket member's releasable connector means being too weak to retain the outermost socket member from being forced inwardly toward the handle member by the reaction by the work object against the axial force applied to the shank member by the user in using the tool, that retention being wholly by force transmission operative from the said abutment means and through the socket members including and inwardly of the outermost socket member as are carried on the shank member.

2. The invention as set forth in claim 1, in which the rotation blocking means comprises the shank member being formed to have non-circular cross-section, and the outermost socket member being formed such that its bore is operatively non-circular in cross-section in its central portion.

3. The invention as set forth in claim 1, in which the shank member's abutment means is provided by the outwardly-facing end of the handle member.

4. The invention as set forth in claim 1, in which the shank member's releasable connection means is provided by a spring, and a snubber member spring-pressed radially outwardly of the shank member.

5. The invention as set forth in claim 2, in which the shank member's abutment means is provided by the outwardly-facing end of the handle member.

6. The invention as set forth in claim 2, in which the shank member's releasable connection means is provided by a spring, and a snubber member spring-pressed radially outwardly of the shank member.

7. The invention as set forth in claim 3, in which the shank member's releasable connection means is provided by a spring, and a snubber member spring-pressed radially outwardly of the shank member.

8. The invention as set forth in claim 1, in which each end of at least one of the socket members is provided with a socket of a size/shape different than the size/shape of the socket at the other end of that socket member and different from the size/shape of the shank member; and the releasable connection permits the various socket members to be optionally used as the outermost socket member for operatively engaging the associated work object for torque-force imposition, and either end of the outermost socket member to be optionally carried as the outwardly facing end thereof, thereby providing the optionality of each end of each socket member to be the one which operatively engages the work object for the torque-force imposition.

9. The invention as set forth in claim 2, in which each end of at least one of the socket members is provided with a socket of a size/shape different than the size/shape of the socket at the other end of that socket member and different from the size/shape of the shank member; and the releasable connection permits the various socket members to be optionally used as the outermost socket member for operatively engaging the associated work object for torque-force imposition, and either end of the outermost socket member to be optionally carried as the outwardly facing end thereof, thereby providing the optionality of each end of each socket member to be the one which operatively engages the work object for the torque-force imposition.

10. The invention as set forth in claim 3, in which each end of at least one of the socket members is provided with a socket of a size/shape different than the size/shape of the socket at the other end of that socket member and different from the size/shape of the shank member; and the releasable connection permits the various socket members to be optionally used as the outermost socket member for operatively engaging the associated work object for torque-force imposition, and either end of the outermost socket member to be optionally carried as the outwardly facing end thereof, thereby providing the optionality of each end of each socket member to be the one which operatively engages the work object for the torque-force imposition.

11. The invention as set forth in claim 4, in which each end of at least one of the socket members is provided with a socket of a size/shape different than the size/shape of the socket at the other end of that socket member and different from the size/shape of the shank member; and the releasable connection permits the various socket members to be optionally used as the outermost socket member for operatively engaging the associated work object for torque-force imposition, and either end of the outermost socket member to be optionally carried as the outwardly facing end thereof, thereby providing the optionality of each end of each socket member to be the one which operatively engages the work object for the torque-force imposition.

12. The invention as set forth in claim 5, in which each end of at least one of the socket members is provided with a socket of a size/shape different than the size/shape of the socket at the other end of that socket member and different from the size/shape of the shank member; and the releasable connection permits the various socket members to be optionally used as the outermost socket member for operatively engaging the associated work object for torque-force impostion, and either end of the outermost socket member to be optionally carried as the outwardly facing end thereof, thereby providing the optionality of each end of each socket member to be the one which operatively engages the work object for the torque-force imposition.

13. The invention as set forth in claim 6, in which each end of at least one of the socket members is provided with a socket of a size/shape different than the size/shape of the socket at the other end of that socket member and different from the size/shape of the shank member; and the releasable connection permits the various socket members to be optionally used as the outermost socket member for operatively engaging the associated work object for torque-force imposition, and either end of the outermost socket member to be optionally carried as the outwardly facing end thereof, thereby providing the optionality of each end of each socket member to be the one which operatively engages the work object for the torque-force imposition.

14. The invention as set forth in claim 7, in which each end of at least one of the socket members is provided with a socket of a size/shape different than the size/shape of the socket at the other end of that socket member and different from the size/shape of the shank member; and the releasable connection permits the various socket members to be optionally used as the outermost socket member for operatively engaging the associated work object for torque-force imposition, and either end of the outermost socket member to be optionally carried as the outwardly facing end thereof, thereby providing the optionality of each end of each socket member to be the one which operatively engages the work object for the torque-force imposition.

* * * * *